US005287706A

United States Patent [19]

Williams

[11] Patent Number: 5,287,706

[45] Date of Patent: Feb. 22, 1994

[54] REFRIGERATION SYSTEM AND SUBCOOLING CONDENSER THEREFOR

[76] Inventor: Alea Williams, 2113 Emerson St., Evanston, Ill. 60201

[21] Appl. No.: 991,186

[22] Filed: Dec. 16, 1992

[51] Int. Cl.[5] ..... F25B 41/04

[52] U.S. Cl. ..... 62/196.1; 62/117

[58] Field of Search ..... 62/506, 196.1, 117, 62/498

[56] References Cited

U.S. PATENT DOCUMENTS

| | | | |
|---|---|---|---|
| 2,613,513 | 10/1952 | Shields | 62/506 X |
| 2,983,115 | 5/1961 | Caswell | 62/285 |
| 3,212,992 | 10/1965 | Salesse et al. | 176/81 |
| 3,264,837 | 8/1966 | Harnish | 62/117 |
| 3,321,929 | 5/1967 | Little | 62/181 |
| 3,852,974 | 12/1974 | Brown | 62/79 |
| 3,926,008 | 12/1975 | Webber | 62/506 X |
| 4,144,718 | 3/1979 | Williams | 62/180 |
| 4,227,572 | 10/1980 | Harlan | 165/184 |
| 4,242,881 | 1/1981 | Williams | 62/225 |
| 4,330,036 | 5/1982 | Satoh et al. | 165/179 |
| 4,348,794 | 9/1982 | Kim | 29/157.3 |
| 4,380,912 | 4/1983 | Edwards | 62/506 |
| 4,549,606 | 10/1985 | Sato | 165/179 |
| 4,577,463 | 3/1986 | Nunn, Jr. et al. | 62/117 X |
| 4,732,007 | 3/1988 | Dolan | 62/79 |
| 4,787,211 | 11/1988 | Shaw | 62/117 |

*Primary Examiner*—William E. Tapolcai
*Attorney, Agent, or Firm*—Tilton Fallon Lungmus

[57] ABSTRACT

An improved refrigeration system is disclosed for chilling a circulating water supply, particularly a supply intended for cooling industrial equipment. The system includes a water container having at least one coiled water tube disposed in the container and positioned in heat-transfer relation with respect to at least one coiled refrigerant-conducting passage external to the water tube(s). A pump circulates water through the water tube(s) in a direction opposite the flow of refrigerant through the adjacent refrigerant-conducting passage(s). The refrigerant circulating system includes two circuits, the first of which connects the outlet of the condenser-compressor to the inlet of the coiled refrigerant-conducting passage(s), and the second of which includes a subcooling condenser tube disposed within the body of water in the container and interposed between the condenser/compressor and the inlet of the refrigerant-conducting passage(s). A plurality of thermostatically-controlled valves are provided to selectively divert refrigerant from the first circuit to the second circuit when ambient temperatures exceed a predetermined level so that refrigerant will be pre-cooled in the subcooling condenser to increase the efficiency of the refrigeration system.

11 Claims, 1 Drawing Sheet

Fig. 1
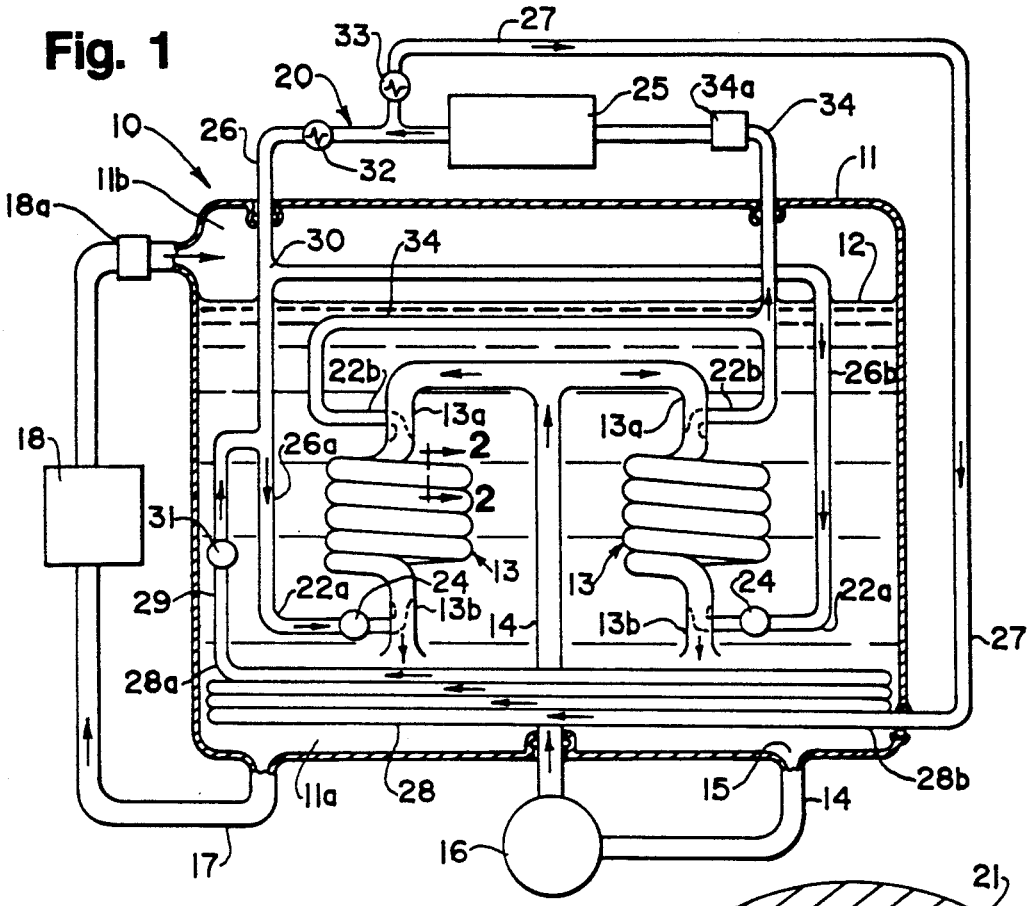
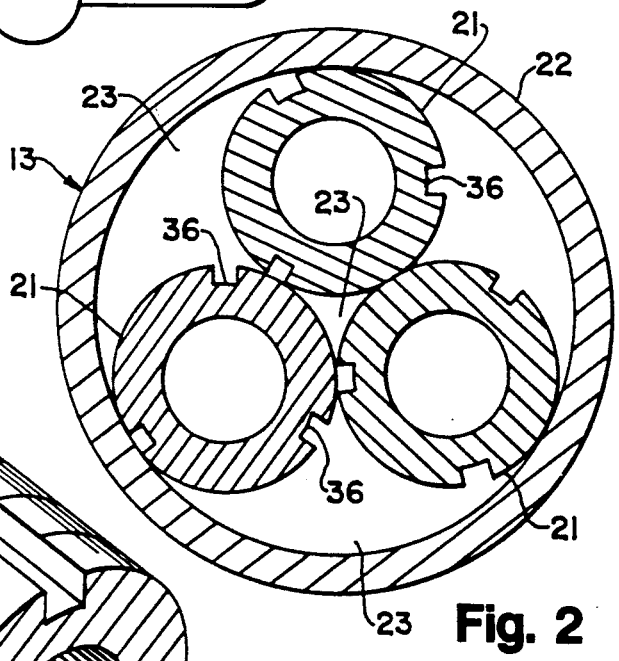
Fig. 2
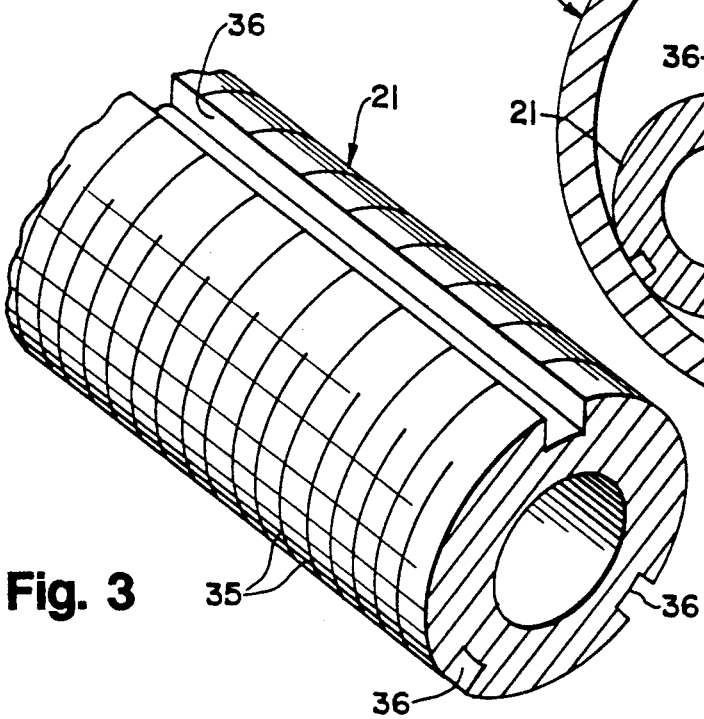
Fig. 3

REFRIGERATION SYSTEM AND SUBCOOLING CONDENSER THEREFOR

BACKGROUND AND SUMMARY

This invention relates to an improved refrigeration system for cooling a water supply to be circulated through or around industrial equipment and other similar equipment, and particularly to a system which includes a subcooling condenser.

Water chillers are useful for cooling a circulating water supply for use in maintaining industrial equipment at desired operating temperatures. Such equipment may take the form of machines for blow molding, injection molding, extruding, printing and etching, chemical processing, food processing, and the like. It has been found, for example, that the use of water chillers with industrial machines such as hydraulic presses, compressors, metal treating ovens, and special metal fabrication processes results in definite improvements in operating efficiency. However, water chillers used in the past have often taken the form of large and complex refrigeration systems operating at high energy levels and, even then, oftentimes failing to achieve a satisfactory temperature drop in a circulating water supply when ambient temperatures are excessive.

With respect to prior water chillers, such refrigeration systems have usually been of conventional designs. The coiled refrigerant tubes or evaporators are simply immersed in a container of water to chill the water used for cooling the industrial equipment. Even when such a chiller is used, however, ambient temperatures often reach high levels and greatly reduce the water cooling capacity of the system. For example, it has been found that a typical refrigerant compressor loses between 6 and 10% cooling capacity for each 10° F. of ambient temperature which exceeds 95° F. There has therefore developed a need to somehow increase refrigeration capacity when relatively high ambient temperatures impede the efficiency of such a compresser.

Several methods have been suggested in the art for increasing the refrigeration capacity of a chiller, such as by increasing compressor capacity or the volume of refrigerant used in the system. Other methods known in the art include bringing the refrigerant gas, downstream from the evaporator, into a heat exchange relationship with condensed refrigerant leaving the condenser. Systems which cool refrigerant leaving a condenser are known in the art, it being recognized that cooling condensed refrigerant at a high temperature, for example 125° F., is easier to accomplish than cooling refrigerant at a relatively low temperature, for example −40° F. One prior system for subcooling condense refrigerant is exemplied in U.S. Pat. No. 3,582,974 which teaches the use of a secondary refrigeration system. In such a system, a secondary refrigerant circuit includes evaporator coils in heat transfer relationship with a primary refrigerant circuit so as to subcool the condensed refrigerant of the primary circuit before the refrigerant reaches an expansion valve. Although such a system increases the efficiency of the primary refrigeration system by subcooling the condensed refrigerant, such increases in efficiency tend to be largely offset by the cost and complexity of providing a secondary refrigeration system.

In the system of the present invention, refrigerant leaving the condenser may be subcooled to increase the refrigerating capacity of the system. A coiled subcooling condenser tube is disposed in the body of water to be cooled by the system. When ambient temperatures exceed a predetermined level, the flow of condensed refrigerant through a first circuit which leads directly to the expansion valve of the evaporator coil is rerouted through a second circuit which includes the subcooling condenser coil immersed in the body of water. Refrigerant flowing through the subcooling condenser at high temperature, for example at 125° F., is subcooled by the chilled body of water in the container which is at a relatively low temperature, for example, at 40° F. The cooled refrigerant then flows through the expansion valve at a relatively low temperature, resulting in a lower refrigerant temperature in the evaporator and thereby increasing the refrigerating capacity of the system to compensate for the decreased capacity of the compressor.

In a preferred embodiment, the heat exchange between the coiled water tubes and the associated refrigerant passages takes the form of at least one coiled refrigerant-conducting tube which contains a plurality of smaller water tubes having outer surfaces that are threaded, or provided with generally circumferentially-extending ribs, and having longitudinally-extending channels along their outer surfaces. The refrigerant-conducting tube and water-conducting tubes therein are formed of metal having relatively high thermal conductivity and that, combined with the relatively large inside diameter of the refrigerant-conducting tube and the substantial surface area of the water tubes therein, provides an arrangement that promotes high thermal transfer efficiency in the refrigeration system.

Other features, advantages, and objects of the invention will become apparent from the specification and drawings.

DRAWINGS

FIG. 1 is a schematic view of an improved refrigeration system embodying the present invention.

FIG. 2 is an enlarged cross sectional view taken along line 2—2 of FIG. 1.

FIG. 3 is an enlarged fragmentary perspective view of one of the water-conducting tubes employed in this invention.

DESCRIPTION OF PREFERRED EMBODIMENT

Referring to the drawings, the numeral 10 generally designates an improved refrigeration system for chilling a circulating water supply for use in cooling industrial equipment. The system includes a water container 11 having a body of water 12 therein. Water cooling means takes the form of at least one coil assembly 13 disposed in the body of water, each coil having a water inlet **13*a* and a water outlet 13*b*. In the schematic view of FIG. 1, two such coil assemblies 13 are shown and, in a larger system, an even greater number may be provided. It will be observed that outlets 13*b* discharge water into the lower portion of tank 11 and that inlets 13*a* communicate with a conduit 14 that draws water through a port 15 at the bottom 11*a* of the tank. Water pumping means 16 is interposed along line 14** for circulating water through the coil assemblies.

Container 11 also communicates with a conduit 17 that draws cool water from the lower portion of the container and circulates it through or around the equipment 18 to be cooled by the circulating water of the refrigeration system. Equipment 18, diagramatically depicted in FIG. 1, therefore functions as a heat load.

Suitable pumping means is provided by such equipment to direct the cool water to the load through conduit 17 and the water, thereafter warmed by the load, is returned through filter 18*a* to the upper portion 11*b* of the container.

In the illustration given, each coil assembly 13 includes a plurality of water-conducting tubes 21 communicating with conduit 14 and extending through the interior of a larger refrigerant-conducting tube 22. Refrigerant therefore flows through the spaces or passages surrounding water tubes 21. Three such water tubes 21 are depicted in the assembly 13 of FIG. 2, but it will be understood that a greater or smaller number of such water-conducting tubes may be provided within each refrigerant tube 22. Each refrigerant-conducting tube has refrigerant inlet means 22*a* adjacent the water outlet means 13*b* and refrigerant outlet means 22*b* adjacent the water inlet means 13*a* so that refrigerant and water flow in opposite directions through parallel passages of the heat-exchange coil assemblies.

The refrigerant circulating means 20 also includes an expansion valve 24 associated with the inlet means 22*a* of each refrigerant-conducting tube 22 and means 25 for compressing and condensing refrigerant. Condenser/-compressor 25 may include a conventional freeze control that cuts power to the compressor in the event that ice forms in the water circuit, thereby protecting the refrigeration system against damage from freezing. Between the outlet of the condenser/compressor 2 and each refrigerant inlet 22*a* are two circuits for the flow of refrigerant. The first circuit comprises an outflow conduit 2 that extends directly from the condenser/compressor 25 to each refrigerant inlet passage 22*a*. A second circuit takes the form of an outflow conduit 27 that leads from the outlet of the condenser/compressor to a subcooling condenser tube 28 located in the lower portion 11*a* of the container 11, preferably beneath the water outlets 13*b* of the coil assemblies. The subcooling condenser tube 28 may be coiled in the lower portion of container 11 to promote greater heat transfer between the refrigerant carried by that tube and the body of water 12 in the container 11. Outlet 28*a* of the subcooling condenser communicates with conduit 29 that in turn communicates with refrigerant passage 26. It will be observed from FIG. 1 that refrigerant conduit 26, which normally carries refrigerant directly from the condenser/compressor 25 in the direction represented by the arrows (i.e.,when the subscooling condenser 28 is in operative), is bifurcated at 30 to provide branch passages 26*a* and 26*b* leading to the refrigerant inlet passages 22*a* of the respective coil assemblies.

A check valve 31 is located along conduit 29 and a pair of thermostatically-controlled solenoid valves 32 ad 33 are located near condenser/compresser 25 along lines 26 and 27, respectively. Outlet or return-flow passages 34 lead from the refrigerant outlets 22*b* of the coil assemblies 13 back to the inlet of condenser/compresser 25.

Solenoid-controlled valves 32 and 33 operate in opposition, with one being closed whenever the other is open. In normal operation, refrigerant flows from condenser/compresser 25 into the outflow line 26 of the first circuit. Valve 32 is open and valve 33 is closed, so refrigerant flows directly from the condenser/compressor to refrigerant inlets 22*a* and expansion valves 24 where it enters the passages 23 of coil assemblies 13. Expansion of refrigerant in the passages 23 of each evaporator coil assemblies results in the transfer of heat from the water in tubes 21 to the refrigerant flowing through the passages external to the water-conducting tubes resulting in cooling of the water counterflowing through the water-conducting tubes. After flowing through the heat-transferring coil assemblies 13, the refrigerant exits through outlets 22*b* and returns to the condenser/compressor 25 through passages 34. A conventional compressor pressure relief (CPR) valve 34*a* is preferably included along return line 34 to modulate flow and protect the compressor against possible damage resulting from excessive pressures.

When a predetermined ambient temperature is exceeded, as determined by suitable thermostatic means exposed to ambient temperatures and/or by conventional pressure sensing means along return line 34 that responds to pressure changes caused by changes in ambient temperature conditions (not shown), the solenoid valves 32 and 33 reverse their settings so that refrigerant from the condenser/compressor 25 follows the second circuit and passes into outflow conduit 27 leading to the inlet 28*b* of subcooling condenser 28. Condensed refrigerant flows through the coiled tubing of the subcooling condenser where it is cooled by water 12 in the lower portion of container 11 prior to entering conduit 29 and passing through check valve 31. The refrigerant from the subcooling condenser enters conduit 26 below closed solenoid valve 32 and enters inlet means 22*a* of the two coil assemblies through branch passages 26*a* and 26*b*, respectively. Condensed refrigerant leaving the condenser/compressor 25 under relatively high ambient conditions—for example, 125° to 130° F.—is considerably warmer than the water 12 in container 11. The condensed refrigerant, being at a relatively high temperature and in a liquid state, is readily cooled as it flows through the subcooling condenser 28 submerged in the chilled water having a temperature, for example, of 40° F. Ideally, the size of the subcooling condenser 28—that is, the length of its flow passage—should be limited so that refrigerant does not enter expansion valves 24 at temperatures substantially lower than about 75° F.

A characteristic feature of this system is that the subcooling condenser 28 is disposed in a comparatively large body of water supported within container 11. As the subcooling condenser 28 is relatively small in comparison with the body of chilled water, the higher temperature of the condensed refrigerant flowing through the condenser 28 does not cause a significant increase in the temperature of the body of water. Operation of the system may be optimized by regulating the rate of flow through pump 16 and heat load 18. It is preferable that pump 16 have a higher rate of circulation than the rate at which the pumping system of load 18 circulates water from container 11. For example, pump 16 may be set so as to circulate water through the coil assemblies 13 at a rate four times the rate at which heat load 18 draws water from container 11. Pump 16 is preferably operated to continuously circulate water through the coil assemblies 13 with the heat load 18 drawing off only a relatively small portion of the cooled water supported in container 11. The subcooling condenser 28 therefore effects only a small temperature difference in the body 12 of chilled water so that the temperature of that body remains relatively stable or substantially constant even though ambient conditions trigger operation of the second refrigerant circuit.

FIGS. 2 and 3 reveal the construction of the water-conducting tubes 21 encased in refrigerant tubes 22. By providing a plurality of heat-transferring water-conducting tubes 21, the surface area of those tubes exposed to the counterflow of refrigerant through outer tube 22 of each coil assembly 13 is substantial, thereby promoting high heat transfer efficiency in the system. That efficiency is further enhanced by providing the water-conducting tubes 21 with a series of circumferentially-extending ribs or threads 35 and a plurality of longitudinal channels 36 which substantially increase the surface area of the tubes 21 exposed to refrigerant flow. Three such channels 36, spaced uniformly apart, are depicted in FIGS. 2 and 3, but it will be understood that a greater (or smaller) number may be provided, if desired.

The tubes 21 and 22 of the heat exchange coil assemblies, and the coiled tubing of the subcooling condenser 28, may be formed of any suitable material having relatively high thermal conductivity. Metals such as copper or aluminum are preferred, but other materials having similar properties may be selected.

While in the foregoing I have disclosed an embodiment of the invention in considerable detail for purposes of illustration, it will be understood by those skilled in the art that many of those details may be varied without departing from the spirit and scope of the invention.

I claim:

1. An improved thermal exchange assembly for industrial use comprising a water container; water cooling means including at least one water-conducting tube disposed in said container having water inlet means at one end thereof for receiving water from said container and having water outlet means at the opposite end thereof for discharging water into said container; water pumping means for circulating water through said water-conducting tube; refrigerant circulating means comprising at least one refrigerant-conducting tube disposed in said container in heat exchange relation with water in said water-conducting tube; said refrigerant-conducting tube having refrigerant inlet means adjacent said water outlet means and refrigerant outlet means adjacent said water inlet means; said refrigerant inlet means including a refrigerant expansion valve; said refrigerant circulating means including means for condensing and compressing refrigerant; said refrigerant circulating means also including a first refrigerant circuit having first outflow conduit means for conducting refrigerant from said condensing and compressing means directly to said refrigerant inlet means and return conduit means for conducting refrigerant from said refrigerant outlet means back to said condensing and compressing means; and a second refrigerant circuit including a subcooling condenser tube having an inlet and an outlet disposed in said container, second outflow conduit means for conducting refrigerant from said condensing and compressing means to said inlet of said subcooling condenser tube, and conduit means joining said outlet of said subcooling condenser tube to said refrigerant inlet means; and control valve means for selectively directing refrigerant through each of said first and second refrigerant circuits.

2. The assembly of claim 1 in which said control valve means comprises a plurality of thermostatically-operated solenoid valves for directing refrigerant through either said first refrigerant circuit or said second refrigerant circuit.

3. The assembly of claim 1 in which conduits are provided for circulating water between said container and a heat load to be cooled by water from said container; means provided along said conduits for circulating water to and from said heat load; said circulating means circulating water to and from said heat load at a rate substantially lower than said water pumping means circulates water through said water-conducting tube.

4. The assembly of claim 1 in which said water-conducting and refrigerant-conducting tubes comprise a coil assembly in which said water-conducting tube is disposed within said refrigerant-conducting tube in parallel relation therewith; said water-conducting tube having a substantially smaller outside diameter than the inside diameter of said refrigerant-conducting tube.

5. The assembly of claim 4 in which a plurality of said water-conducting tubes are disposed within said refrigerant-conducting tube.

6. The assembly of claim 5 in which each water-conducting tube has a multiplicity of axially-spaced and generally circumferentially-extending ribs.

7. The assembly of claim 5 in wich each of said water-conducting tubes has a plurality of circumferentially-spaced longitudinally-extending external grooves.

8. The assembly of claim 1 in which said subcooling condenser tube is located within the lower portion of said container.

9. The assembly of claim 8 in which said water-conducting tube and said refrigerant-conducting tube are concentrically arranged to form a heat-exchange coil assembly; said subcooling condenser tube being located beneath said coil assembly.

10. The assembly of claim 9 in which said subcooling condenser tube is coiled.

11. The assembly of claim 4 in which a plurality of said coil assemblies are disposed in said container.

* * * * *